United States Patent [19]

Cox

[11] Patent Number: 4,907,657

[45] Date of Patent: Mar. 13, 1990

[54] METHOD FOR PROTECTING A SHALLOW WATER WELL

[75] Inventor: Bobby E. Cox, Kenner, La.

[73] Assignee: Shell Offshore, Inc., Houston, Tex.

[21] Appl. No.: 241,802

[22] Filed: Sep. 7, 1988

Related U.S. Application Data

[63] Continuation of Ser. No. 936,220, Dec. 1, 1986, abandoned.

[51] Int. Cl.[4] ..... E02B 17/02; E02D 31/00

[52] U.S. Cl. ..... 175/9; 405/195; 405/227

[58] Field of Search ..... 175/9; 405/195, 211, 405/216, 203, 227, 201

[56] References Cited

U.S. PATENT DOCUMENTS

| | | | |
|---|---|---|---|
| 3,362,170 | 1/1968 | Manning | 175/9 |
| 3,389,562 | 6/1968 | Mott et al. | 405/227 X |
| 3,483,708 | 12/1969 | Marshall | 175/7 X |
| 3,508,409 | 4/1970 | Cargile, Jr. | 175/5 X |
| 4,069,683 | 1/1978 | Jansz | 405/228 X |
| 4,084,385 | 4/1978 | Boyadjieff | 405/228 |
| 4,109,476 | 8/1978 | Gracia | 61/87 |
| 4,110,993 | 9/1978 | Heerema | 405/228 |
| 4,228,857 | 10/1980 | Nobileau | 175/7 X |
| 4,269,542 | 5/1981 | Mueller | 405/203 |
| 4,391,332 | 7/1983 | Fayren | 166/350 |
| 4,401,398 | 8/1983 | Remson | 166/367 X |
| 4,422,805 | 12/1983 | Sweatman | 405/227 |
| 4,437,791 | 3/1984 | Reynolds | 405/195 |
| 4,558,973 | 12/1985 | Blandford | 405/227 |
| 4,592,422 | 6/1986 | Hipp | 166/96 |
| 4,739,840 | 4/1988 | Cox | 175/9 |

FOREIGN PATENT DOCUMENTS

| | | | |
|---|---|---|---|
| 019808 | 2/1985 | Japan | 405/228 |
| 208513 | 10/1985 | Japan | 405/228 |
| 8401934 | 1/1986 | Netherlands | 405/227 |
| 628232 | 10/1978 | U.S.S.R. | 407/227 |
| 1563107 | 3/1980 | United Kingdom | 405/227 |
| 2153886 | 8/1985 | United Kingdom | 405/227 |

*Primary Examiner*—Bruce M. Kisliuk

[57] ABSTRACT

Method of utilizing a jack-up well drilling rig in shallow water to drill an isolated well having an unsupported well conductor, and subsequently to attach a reinforcing frame near the water line and to drive pile through the frame into the ocean floor without moving the jack-up rig off location.

11 Claims, 3 Drawing Sheets

FIG. 4
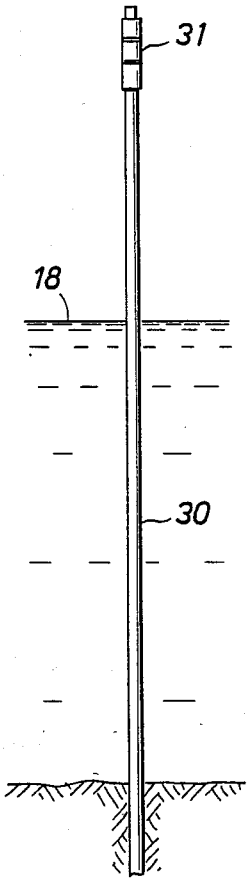
FIG. 5
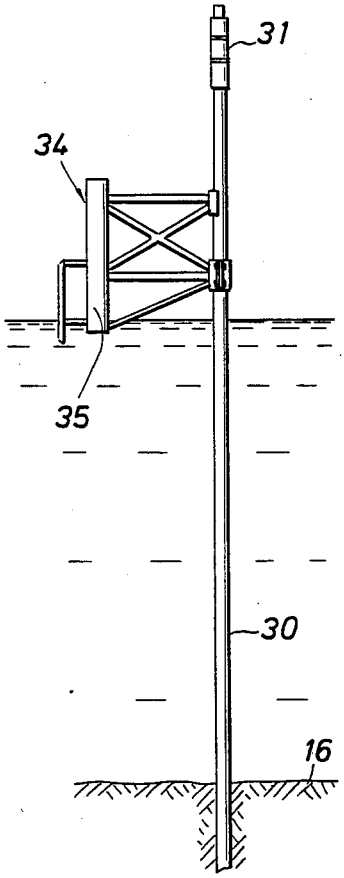
FIG. 6
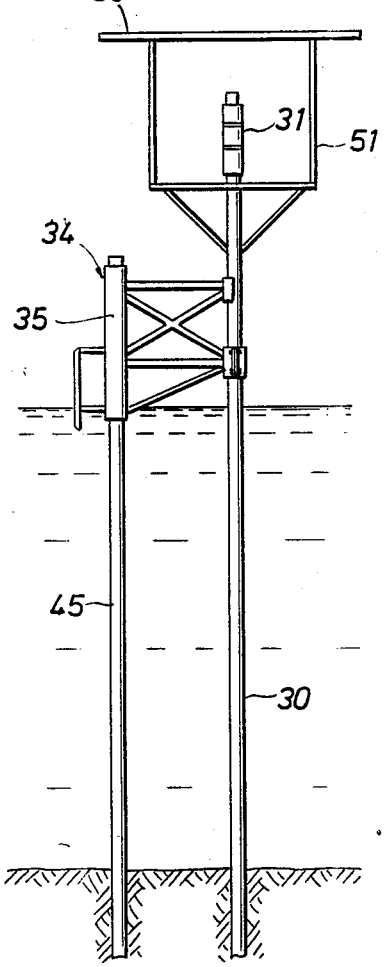
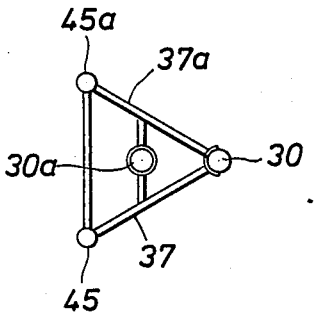
FIG. 9
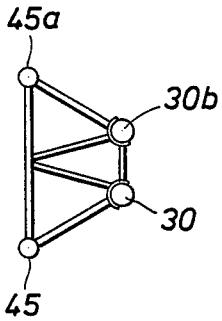
FIG. 10
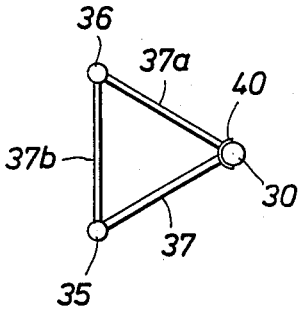
FIG. 11

METHOD FOR PROTECTING A SHALLOW WATER WELL

This is a continuation of application Ser. No. 936,220, filed Dec. 1, 1986 now abandoned.

This invention relates to a method and apparatus for protecting the well conductor of a shallow water well which may be drilled from a jack-up rig in locations where only a few wells are to be drilled.

Background of the Invention

From time to time, offshore structures in the form of large offshore platforms are erected on the ocean floor for the purpose of drilling a large number of wells into the ocean floor in order to develop and oil or gas fields. In shallow water locations where small amounts of oil and gas have been found, the erection of a large platform could not be economically justified. Thus, at times, only a single well need be drilled down to the oil deposit. Alternatively, single wells are often drilled in extensions of known fields to develop small deposits. At other times, it is often desired to drill a single well and evaluate the field production for a year prior to going forward with further drilling of that area.

In shallow water, of say, 50 feet in depth, a single well would be drilled by driving a large-diameter drive pipe or well conductor into the ocean floor from a jack-up rig. The well conductor, which may be 48 inches in diameter, forms the outer tubular member of a well installation. A well is drilled through the well conductor in a manner well known to the art and then is closed at the top by a well head assembly of the type used in producing a well. A single well of this type is normally protected by fabricating onshore a well protector jacket which is normally square in cross-section and extends for a height equal to the distance between the ocean floor and the wellhead at the top of the well conductor. Such a jacket is transported by barge or otherwise to the offshore location where a derrick barge is employed to lift the jacket above the wellhead and slip it down over the wellhead and well conductor to the ocean floor. Piles are then driven down through the corner legs of the jacket to anchor it to the ocean floor.

Summary of the Invention

The present invention is directed to apparatus for reinforcing shallow water wells and a method for installing the apparatus at an offshore location. The present apparatus includes simple structural components that require a minimum of labor offshore in connecting the apparatus to a well conductor. The apparatus is designed so that only connections are made above the water line to facilitate the assemblage of the apparatus.

It is an object of the present invention to provide an apparatus to be connected to a well conductor to aid the conductor in resisting the forces of wind and waves to which it is subjected.

It is a primary object of the present invention to provide a method of drilling a shallow water offshore well and reinforcing the well structure from a jack-up type drilling platform having a derrick and associated drilling and hoisting systems thereon. The method contemplates employing a jack-up drilling platform for driving the well conductor, drilling the well through the conductor, and subsequently reinforcing the well conductor with the apparatus of the present invention and driving piles through the reinforcing apparatus without moving the jack-up platform from its original drilling position. The jack-up platform is provided with a drilling rig or derrick which is moveable laterally on its base platform or operating platform so that the derrick may be moved to an operative position which is outboard of the elevated operating platform. A jack-up platform having its derrick on a cantilevered section of the platform may be employed or, alternatively, a jack-up rig having a drilling slot in the platform extending inwardly from the outer edge thereof, may be used. Thus, in either case a jack-up platform is employed which is of a design that provides for the derrick to be moved laterally on the platform within a prescribed work area so that the center line of the derrick, and thus its hoist system, is positioned over open water to one side or outboard of the platform, or over the slot therein if one is present.

The jack-up drilling platform is located at a selected shallow water drilling location and its leg footings are set on the ocean floor while subsequently the operating deck is jacked up to the normal operating position above the water surface and wave action. By use of the hoist system of the derrick, a large diameter well conductor, say, 48 inches in diameter, is lowered through the water below the derrick and set into the ocean floor. Generally, the well conductor is driven into the ocean floor by means of a pile driver to refusal. A well is drilled through the well conductor from the jack-up platform and the top of the well conductor is closed by means of a conventional wellhead.

In order to reinforce the finished well installation, a relatively small reinforcing frame, which has been previously fabricated onshore, is transported to the jack-up platform where one corner of it is positioned against the well conductor. At least two other corners of the reinforcing frame are provided with vertical pile guide sleeves of 10 feet or more in length through which piles may be driven into the ocean floor. With the reinforcing frame hung below the jack-up platform, its derrick is moved so that the center line thereof is over one of the pile guide sleeves of the reinforcing frame. The hoist system of the derrick then picks up from 40 to 80 feet of pile and lowers it through the pile guide sleeve and, by means of a pile driver, drives it into the ocean floor. Additional lengths of pile are welded to the upper end of the driven pile at the operating deck of the platform in a manner well known to the art. After the piles have been driven to the selected depths, they are connected to the reinforcing frame in any suitable manner. The frame is also connected to the well conductor either before or after the piles are driven.

By employing the method and apparatus of the present invention, well conductors of thinner-walled pipe may be satisfactorily employed when reinforced in accordance with this invention. Additionally, single well conductors may be used in deeper waters with satisfactory results when protected in the present manner.

Instead of following the normal procedure of drilling an offshore well from a drilling vessel, then moving the vessel off location, then subsequently moving back onto the location with a derrick barge and a reinforcing structure to be positioned over around the offshore well, it is an object of the present invention to provide a method and apparatus whereby all of the operations of drilling and reinforcing the well assembly can be carried out from a jack-up platform without ever moving off location until the entire operation has been completed. This would reduce the cost of the operations about $1,000,000 by utilizing the present method.

BRIEF DESCRIPTION OF THE DRAWING

These and other objects of the present invention will appear hereinafter from a consideration of the drawing and description.

FIGS. 4, 5 and 6 are partial side elevation views diagrammatically illustrating successive stages in the drilling of a well and the field installation of the reinforcing apparatus of the present invention being positioned and connected to the well conductor;

FIGS. 9, 10 and 11 are plan views illustrating various arrangements of the reinforcing apparatus of the present invention when used on one or two wells.

DESCRIPTION OF A PREFERRED EMBODIMENT

Figure 1:
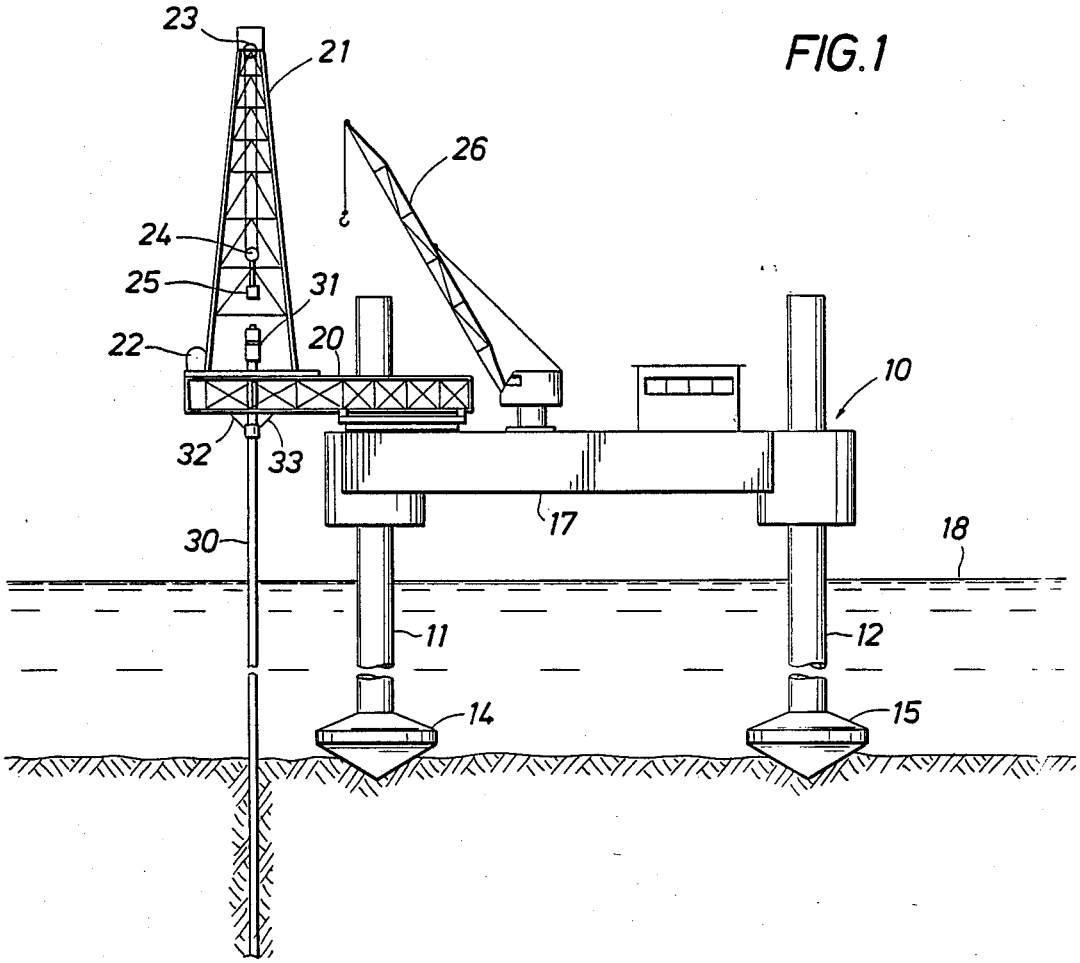
FIG. 1 is a side elevation view of a jack-up platform with a moveable derrick drilling a well in the ocean floor.

Referring to FIG. 1 of the drawing, an offshore jack-up platform or rig 10 is illustrated as being positioned at a drilling location offshore. Two of its three legs 11 and 12 are shown as having been jacked down so that the footings 14 and 15 at the lower end thereof rest on the ocean floor 16 with the operating platform 17 of the jack-up rig having been elevated above the ocean surface 18. In this case the jack-up rig 10 is provided with a cantilevered section of the operating deck 20 which extends outboard of the main deck section 17. A drilling derrick 21 is mounted on the cantilevered section 20A. The derrick 21 is provided with a normal hoist system comprising a hoist 22, crown block 23, travelling block 24, and elevators 25 or other connection means for connecting and lowering pipe into a well or lowering a pile driver (not shown) to drive pile into the ocean floor. A crane 26 is shown as positioned on the deck of the platform to aid in carrying out operations.

Figure 2:
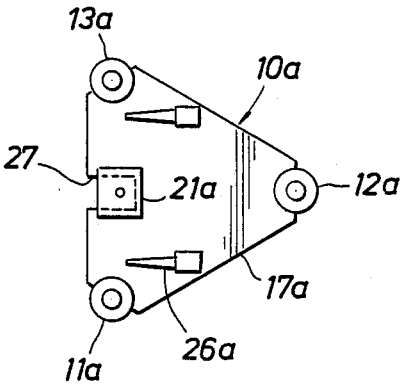
FIG. 2 is a plan view of another type of a jack-up platform having a slot in the operating platform.

In FIG. 2, another form of jack-up platform is shown as having legs 11*a*, 12*a* and 13*a* at the three corners of the triangular-shaped hull which may form the operating deck of the platform 10*a*. The operating deck 17*a* is shown as being provided with a slot 27 which extends inwardly from the outer edge of the deck or hull 17*a* a distance of, say, 35 or 40 feet. The width of the slot 27 is generally about 25 feet. The derrick 21*a* is shown as spanning the slot 27 and is moveable along the length and across the width of the slot as desired. Thus, with the platform located in its drilling position as shown in FIG. 1, the derrick can be moved laterally relative to the outer edge of the operating deck so that the same derrick hoist system can be used to drive pile after the well has been drilled without moving the jack-up platform on the ocean floor.

In FIG. 1 a well has been drilled through a well conductor 30 and is diagrammatically shown as being closed by a wellhead assembly 31. During drilling operations the well conductor may be supported in any suitable manner from the platform 20 as by means of cables 32 and 33. The platform of FIG. 2 may be provided with one or more cranes 26*a*.

Figure 3:
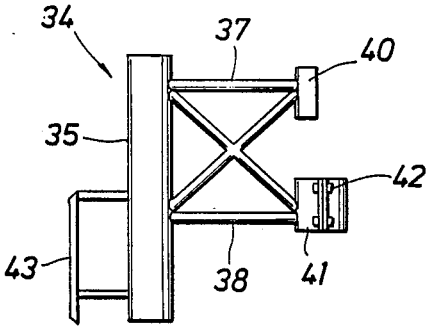
FIG. 3 is a side elevation view of one form of a reinforcing frame in accordance with the present invention.

One form of reinforcing frame or structure to be used to reinforce an unsupported well conductor in shallow water may take the form of a pile guide template frame 34. The pile guide template frame 34 comprises at least two normally vertically-extending open-ended tubular pile guide sleeves 35 and 36 (FIG. 8) of, say, an internal diameter of 40 inches so as to pass a 36-inch diameter pile therethrough. The frame 34 in FIG. 3 is shown as being provided with laterally extending support members 37 and 38 which terminate in suitable connector means 40 and 41 which are configured on their inner surface to fit against or around a well conductor, as desired. The connector plate 40 is of the type that may be welded directly against the outside surface of the well conductor above the water line in order to support the pile guide frame 34 in place prior or subsequent to driving piles therethrough. The connector 41 shown at the end of the lower arm 38 is illustrated as being of the split collar type which would be connected to a well conductor by means of bolts 42. In the event that boats are used to transfer personnel to a well installation to inspect it, the pile guide frame 34 is provided with a boat landing and bumper 43.

The connectors 40 and 41 are positioned at a selected distance from each pile guide sleeve 35 and 36 (FIG. 11), which distance is determined by the type of drilling jack-up platform that is used. In the plan view shown in FIGS. 9, 10 and 11, the overall cross-sectional width of the structure must be less than the width of the slot 27 of a jack-up rig as illustrated in FIG. 2. Alternatively, if the rig of FIG. 1 is employed, the cross-sectional dimension of the well plus its laterally extending support members 37, 37*a* and 37*b* (FIG. 11) must be less than the operational lateral movement of the center line of the derrick 21 on a cantilevered section 20 of platform 10.

In FIGS. 4, 5 and 6, successive steps in the operation of the method of the present invention are illustrated without the jack-up vessel being in place. It is to be remembered however, that all of the operations are carried out from the jack-up platform of FIG. 1 without moving the platform 10 away from the well conductor and well assembly 31 which has been drilled in the ocean floor as shown in FIGS. 1 and 4.

In FIG. 5 the pile guide template frame 34 of FIG. 3 has been transported in any suitable manner, as by barge, out to the jack-up platform where it is picked up by any suitable hoist means on the jack-up platform and positioned so that the connectors 40 and 41 (FIG. 3) are positioned against the well conductor 30 where they may be connected either before or after the pile driving operation. Preferably, the frame 34 is hung off from the bottom of the deck of the platform to the desired level against the well conductor.

With the pile guide frame in place, the derrick 21 is moved laterally until its center line is positioned directly over one of the pile guide sleeves 35 or 36. Lengths of pile are then picked up one at a time and lowered down through the sleeve 35. Additional lengths of pile are welded to the upper end of the pile section being lowered in a manner well known to the art and the pile is driven into the ocean floor, as by means of a pile driver in a manner well known to the art. The pile, when driven in place, is illustrated at 45 in FIG. 6. A follower pile may be used, if desired.

The derrick 21 is then moved laterally to a position over the other spaced-apart pile 36 (FIG. 11) and the operation of picking up piles, lowering them through the pile sleeve 36 and driving them into the ocean floor is repeated. Each of the piles 45 is fixedly secured to the surrounding pile sleeve in any manner well known to the art. For example, the top of each pile may be connected to its surrounding sleeve by means of welding to spacers or shims. Additionally, the annular space formed between each pile and its surrounding sleeve is filled with cement grout in a manner well known to the art.

Figure 7:
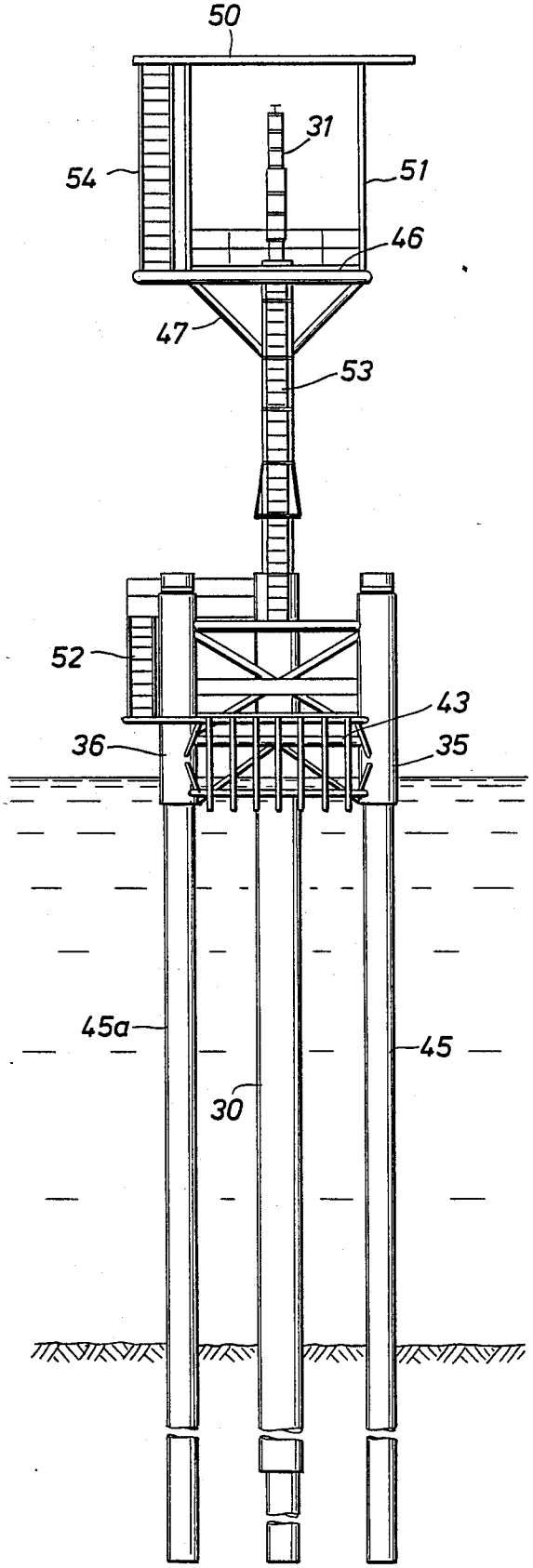
FIGS. 7 and 8 are side and front elevation views of a typical reinforced shallow water well.
Figure 8:
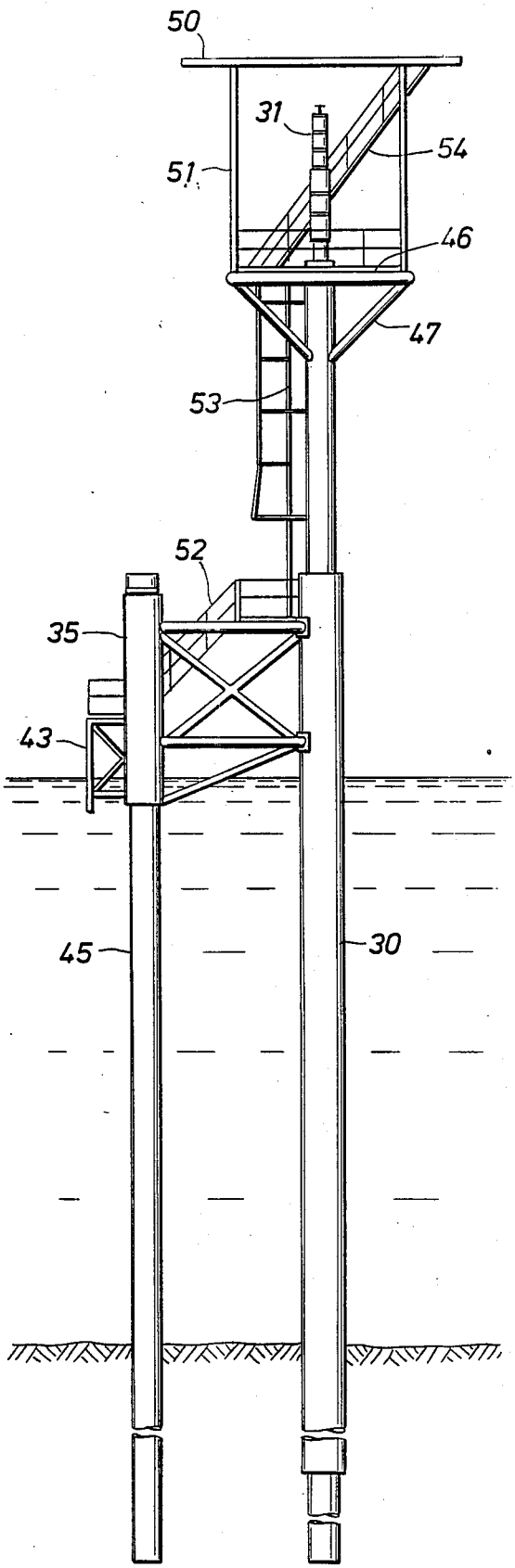

Subsequently, an operating platform 46 may be mounted and affixed to the top of the well conductor 30 below the wellhead assembly to allow personnel or maintenance men to inspect or maintain the well. If desired, a helicopter pad 50, as illustrated in FIGS. 6, 7 and 8, may be mounted above the wellhead assembly 31 by means of a suitable support assembly or frame 51 which in turn is secured to the operating platform 46 and thence to the wellhead conductor 30. Suitable stairways or ladders 52, 53 and 54 can be provided so that personnel can move from the boat landing 43 or helicopter pad 50 to the operating platform 46.

In FIGS. 9 and 10 pile sleeve support frame configurations are shown which provide for two wells 30 and 30A in FIG. 9 with well 30A being separately supported to the support members 37 and 37A by additional cross bracing members. It is to be noted that well **30*a* falls within the periphery of the triangle formed between the piles 45 and 45*a* and the well 30. In FIG. 10, the wells 30 and 30*b*** are on the periphery of the polygonal configuration of the reinforcing frame.

I claim as my invention:

1. A method of drilling a shallow-water offshore well and reinforcing a well structure from a jack-up type drilling platform having a derrick and associated drilling and hoisting systems, said platform being of a design providing for the derrick to be moved laterally on the platform within a prescribed work area so that the center line of the derrick is positioned over open water to one side of the platform, said method comprising the steps of:

(a) drilling and completing the well by steps comprising:

(1) locating the jack-up type drilling platform at a selected shallow-water drilling location with its leg footings on the ocean floor and its operating deck jacked-up to normal operating position above the water surface and wave action;

(2) lowering a large-diameter well conductor through the water below the derrick and setting it in the ocean floor;

(3) drilling a well through said well conductor and closing the top of the well with a wellhead above the water surface and wave action;

(b) establishing an interconnecting reinforcing structure in which said well conductor and a plurality of piles form legs of the structure, comprising:

(1) providing a pile guide template frame substantially polygonal in plan view comprising at least two spaced-apart vertical pile guides connected together by laterally-extending support members with additional laterally-extending support members arranged to extend between and be connected at one end to each of the pile guides and at the other end to the well conductor when positioned thereagainst, with the pile guides being at a selected distance from the well conductor;

(2) transporting the pile guide template frame to the offshore well;

(3) positioning and suspending said frame in a manner such that the other ends of the additional laterally-extending support members are operatively positioned adjacent the wall of said well conductor, said position being such that at least said other ends of said support members at the top of the frame are above the surface of the water and the lowermost portion of the frame does not rest upon the ocean floor;

(4) lowering the piles through said pile guides of said suspended frame and driving said piles into the ocean floor;

(5) securing the suspended pile guide template frame above the ocean floor by fixedly connecting each pile to its surrounding pile guide; and (6) operatively connecting at least said other ends of said laterally-extending support members at the top of the frame to the well conductor, whereby said frame forms the interconnecting reinforcing structure between the piles and the well conductor, substantially polygonal in plan view, to resist the effect of wind and wave forces encountered by said well conductor.

2. The method of claim 1 further comprising:

providing a work platform at the base of said wellhead; and fixedly securing said work platform to at least said well conductor.

3. The method of claim 2 further comprising:

providing a helicopter pad and a depending support frame; and fixedly securing said helicopter pad support frame to at least said work platform.

4. The method of claim 1 wherein the operation carried out in step b(6) is accomplished by providing a sliding connection permitting limited movement between the well conductor and the reinforcing frame.

5. The method of claim 1 wherein in step b(3) the frame is positioned by hanging it from the jack-up drilling platform beneath the derrick thereof while the pile guides are vertically-aligned in spaced relationship with said well conductor.

6. The method of claim 1 wherein between steps b(3) and b(4) the derrick is moved laterally on said drilling platform so that the travelling block of the hoist system is vertically aligned with said pile guides, one at a time, and further comprising:

the step of connecting the derrick hoist system to one end of a pile to raise it within the derrick and lower it through a pile guide of said frame.

7. The method of claim 1 wherein between steps b(3) and b(4) at least the other ends of said support members at the top of the frame are connected to the well conductor by welding.

8. The method of claim 1 wherein each of said piles is connected to its pile guides by grouting.

9. The method of claim 1 wherein in step b(1) the dimensions of the pile guide template frame together with that of the well conductor, when taken in cross-sectional plan view, are small, less than that of a slot of a jack-up platform.

10. The method of claim 9 including the steps of lowering the jack-up platform of the water surface, comprising:

retracting the leg footings to the travelling position; and moving the platform on the water in a direction such that the well conductor and the adjacent piles move out the open end of the platform slot.

11. The method of claim 1 wherein the jack-up drilling platform is provided with a drilling slot extending inwardly from the outer edge of the platform deck with the derrick and its hoist system spanning the drilling slot and being moveably positionable laterally so that the derrick hoist system may be moved to selected locations along at least portions of the width and length of the drilling slot, including the steps of:

moving said derrick laterally to a position such that the derrick hoist system is above a vertical pile guide of said frame;

picking up a length of pile with said derrick hoist system prior to lowering it through said pile guide as per step b(4), and, after driving the pile in the ocean floor; and repositioning said derrick and said hoist system to a position above another pile guide and repeating the pile installation operation.

* * * * *